United States Patent [19]

Allemandou

[11] 4,443,921

[45] Apr. 24, 1984

[54] METHOD FOR THE MANUFACTURE OF HEAT EXCHANGERS WITH CURVED ELEMENTS

[75] Inventor: Michel A. Allemandou, Charenton-le-Pont, France

[73] Assignee: Societe Anonyme Des Usines Chausson, Hauts de Seine, France

[21] Appl. No.: 287,051

[22] Filed: Jul. 27, 1981

[30] Foreign Application Priority Data

Sep. 1, 1980 [FR] France ..... 80 18875

[51] Int. Cl.[3] ..... B23P 15/26

[52] U.S. Cl. ..... 29/157.3 R; 72/369; 228/183; 29/157.3 B; 165/177; 165/181

[58] Field of Search ..... 29/157.3 R, 157.3 A, 29/157.3 B; 228/183; 72/369; 165/177, 181

[56] References Cited

U.S. PATENT DOCUMENTS

| | | | |
|---|---|---|---|
| 1,357,739 | 11/1920 | Steenstrup | 228/183 |
| 3,340,588 | 9/1967 | Mueller et al. | 228/183 |
| 3,443,296 | 5/1969 | Clausing | 72/369 |

FOREIGN PATENT DOCUMENTS

| | | | |
|---|---|---|---|
| 1298638 | 6/1962 | France | 72/369 |

*Primary Examiner*—Howard N. Goldberg
*Assistant Examiner*—V. K. Rising
*Attorney, Agent, or Firm*—Browdy and Neimark

[57] ABSTRACT

A method for the manufacture of heat exchangers where tubes of rectangular section are assembled with dissipators for forming a plane core which is curved by applying a bending force on the small sides of the tubes, thereby making cores. These cores are assembled by engaging the ends of the tubes into tubular plates which are part of boxes.

10 Claims, 7 Drawing Figures

METHOD FOR THE MANUFACTURE OF HEAT EXCHANGERS WITH CURVED ELEMENTS

FIELD OF THE INVENTION

The present invention relates to heat exchangers of the tube and dissipator type, the tubes being connected to tubular plates for the distribution of a circulation fluid.

BACKGROUND OF THE INVENTION

In some uses, it is necessary to use curved heat exchangers which permit their accommodation inside particular containers or inside enclosures of small dimension or of complex shape.

Exchangers of such a nature are used in aeronautics and have also been used in the automobile industry where efforts are increasingly made to lodge these functional structures inside reduced spaces.

Hitherto, in order to make curved exchangers, the tubes had to be bent and then assembled, notably by brazing, to the dissipators and then to the tubular plates. This procedure is lengthy and costly since it requires the mounting of very particular shaped assemblies.

SUMMARY OF THE INVENTION

The invention provides a new method which permits making the heat exchanger exactly in the same way as in the currently practiced technique utilized in the automobile industry, i.e. they are made in in the same way as a plane exchanger.

According to the invention, the method for making heat exchangers having curved elements comprising tubes, which are assembled to corrugated dissipators, is characterized in that rectilinear tubes, of substantially rectangular cross-section, are rigidly assembled to dissipators having the shape of corrugated bands fixed to the large side of the tubes. The unit thus obtained is curved by applying a bending force to the small sides of the tubes.

Moreover, the invention is applicable to the heat exchanger obtained by practicing this method.

According to this second form of the invention, the heat exchanger comprises curved core elements with rectangular tubes and corrugated dissipators, the tubes being connected by their ends to the tubular plates and by their large sides to the corrugated dissipators.

Various other features of the invention will be better understood from the following detailed description thereof.

BRIEF DESCRIPTION OF THE DRAWINGS

Embodiments of the object of the invention are shown, by way of non limiting examples, in the appended drawings.

DETAILED DESCRIPTION OF PREFERRED EMBODIMENTS

Figure 1:
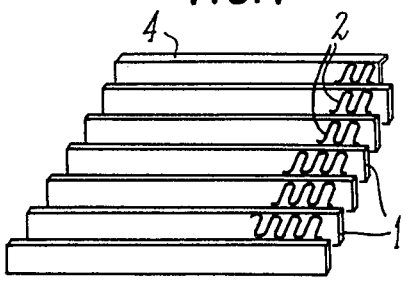
FIG. 1 is a schematic perspective view showing a first phase of the manufacturing method of the heat exchanger of the invention.

As is shown in FIG. 1, the first step consists in making an exchanger core of the single row type comprised of a stacking of tubes 1 and of dissipators 2. The tubes 1 are so-called deep tubes with substantially rectangular or pseudo-rectangular section, a small side being eventually rounded. The dissipators 2 are made of corrugated bands the width of which is at most equal to the height of the large side of the tubes. The dissipators are bonded to the tubes 1 by a brazing or a glue.

The hereabove described core is made such that the ends of the tubes 1 protrude beyond the dissipators 2 over a distance which is just corresponding to that necessary for their subsequent introduction into a tubular plate.

Figure 2:
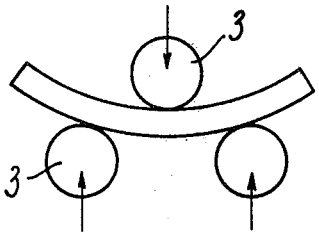
FIG. 2 is a side elevation view showing a subsequent shaping operation.

When the core is ready, it is positioned so as to pass, as is shown in FIG. 2, between forming cylinders 3, for example three in number, of a rolling machine. As a matter of fact, it has been established surprisingly that the dissipators 2 which are fixed to the wall of tubes 1, along their large side, inhibit the buckling of said wall during the bending step by rolling.

When the radius of curvature to be imparted to the core must be small, it is advantageous to carry out several bending steps by moving the cylinders 3 in the direction of the arrow at each step.

Figure 3:
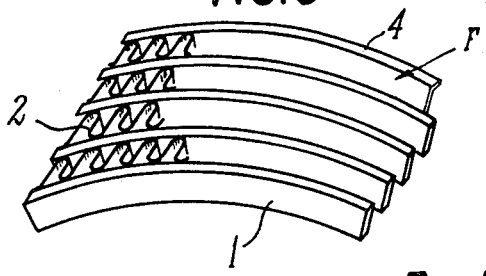
FIG. 3 is a perspective view, similar to FIG. 1, showing the exchanger sections after the shaping operation shown in FIG. 2.

Finally, the core F, shown in FIG. 3, is obtained where the tubes 1 and the dissipators are regularly curved over all their length like an arch.

In many cases, it is advantageous to provide the sides of the core with side flanges. FIGS. 1 and 3 show a side flange 4 which is bent at the same time as the tube. The flanges 4 are generally slightly shorter or slightly longer than the tubes 1 according to a pre-selected fixation mode between said flanges and the tubular plates provided for the tubes 1.

The radius of curvature of the cores F can vary, particularly when it is required to arrange several cores concentrically.

Figure 4:
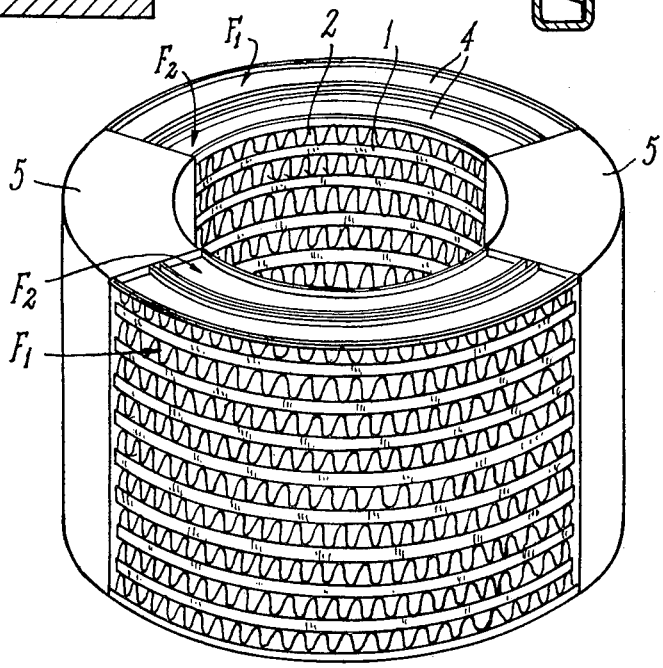
FIG. 4 is an elevation view of a circular exchanger obtained by practicing the method of the invention.

FIG. 4 illustrates the embodiment of a heat exchanger comprising two core sets $F_1$ and $F_2$ of different radius of curvature so that they may be placed concentrically. The tubes 1 of cores $F_1$ and $F_2$ are engaged into tubular plates, not shown, which are part of boxes 5 provided for the connection of the exchanger to a utilization circuit.

The mounting of tubes 1 in the tubular plates can be provided by practicing any method customary in this field. For example, the mounting can be carried out mechanically by disposing flexible seals between the wall of the protruding ends of the tubes and the tube passages of each tubular plate. The tubular plates are then assembled to the boxes 5 by any known means in this field, thereby allowing the making, for example of a circular heat exchanger such as is shown in the figures of the drawing.

In FIG. 4, the heat exchanger is made of two sets of two cores, but is possible, when required and for heat exchangers of large dimensions, to assemble more than two cores per set, or the heat exchanger may have more than two sets of cores.

Figure 5:
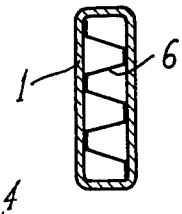
FIGS. 5 and 5*a* are transverse sectional views, at a larger scale, of tubes which can advantageously be used when practicing the method of manufacture of the exchanger of FIG. 4.
Figure 5A:
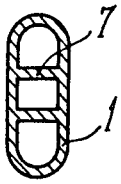

Particularly when it is required to mechanically assemble the tubular plates on the protruding ends of the tubes, it is advantageous that the tubes contain, as is shown on FIGS. 5 and 5a, either a baffle or disturber 6, which is brazed or glued when making the core, or walls 7 formed during the manufacture of the tube, particularly when the tube is an extruded tube (FIG. 5*a*).

For some applications, heat exchangers of a circular shape or only in the shape of an arch of a circle can be made, with a constant or variable radius. This allows making equipment of small size, or adaptable to particular containers, and it is thus possible to use, for activating the thermal exchange, centrifugal turbines disposed inside the cylindrical volume defined by the exchanger.

Figure 6:
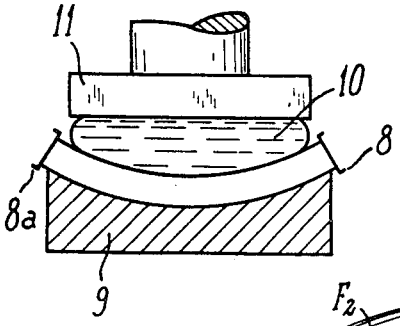
FIG. 6 is a schematic elevation view, similar to FIG. 2, illustrating another shaping method.

According to the alternative embodiment of FIG. 6, the core is provided at both its ends with tubular plates 8, 8*a* which are brazed at the same time as the dissipators 2, and it is positioned on a die 9 of a press, preferably a hydraulic press, and 10 designates a forming bag mounted on a ram 11.

As in the case where the configuration is provided by forming cylinders 3, the core is bent according to the required radius of curvature or radii of curvature without deformation detrimental to the tubes or dissipators.

Also in this embodiment, it is possible to obtain cores of different curvatures, whereby the same core can have several radii of curvature or curvatures which are not circular.

I claim:

1. A method for the manufacture of heat exchangers comprising the steps of:

shaping rectilinear tubes of a substantially rectangular cross section having two parallel smaller sides and two parallel larger sides;

mounting said rectilinear tubes with said larger sides of the tubes being parallely disposed relative to each other and said smaller sides respectively defining two substantially parallel planes;

fixing dissipators in the shape of corrugated bands between said rectilinear tubes on the larger sides thereof, thereby forming a unit; and curving said unit by applying a bending force to said smaller sides of the rectilinear tubes.--.

2. A method according to claim 1, wherein the bending force is provided by passing the unit between cylinders bearing on the smaller sides of the tubes.

3. A method according to claim 1, wherein the unit is curved by means of a die cooperating with a forming element.

4. A method according to any one of claims 2 or 3, wherein the unit comprises, in addition, side flanges.

5. A method according to any one of claims 2 or 3, wherein the unit comprises, in addition, tubular plates.

6. A method according to any one of claims 2 or 3, wherein the forming element is a bag of a hydraulic press.

7. A method according to any one of claims 2 or 3, wherein the width of the corrugated dissipators is chosen such as to be at most equal to the width of the large sides of the tubes.

8. A method according to any one of claims 2 or 3, wherein the tubes-corrugated dissipators unit comprises a single row of tubes.

9. A method according to any one of claims 2 or 3, wherein the tubes are provided with inner partition walls.

10. A method according to claim 9, wherein the inner partition walls are provided with baffles or disturbers.

* * * * *